US008092170B2

(12) United States Patent
Hwang et al.

(10) Patent No.: US 8,092,170 B2
(45) Date of Patent: Jan. 10, 2012

(54) AXIAL FAN

(75) Inventors: Ching-Bai Hwang, Taipei Hsien (TW); Jie Zhang, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 706 days.

(21) Appl. No.: 12/238,443

(22) Filed: Sep. 26, 2008

(65) Prior Publication Data

US 2010/0003131 A1 Jan. 7, 2010

(30) Foreign Application Priority Data

Jul. 4, 2008 (CN) ..... 2008 1 0068325

(51) Int. Cl.
*F01D 1/00* (2006.01)
*F01B 25/02* (2006.01)

(52) U.S. Cl. ..... 415/220; 415/157

(58) Field of Classification Search ..... 415/220, 415/157
See application file for complete search history.

(56) References Cited

U.S. PATENT DOCUMENTS

| | | | | |
|---|---|---|---|---|
| 4,548,548 | A * | 10/1985 | Gray, III | 416/189 |
| 5,577,888 | A * | 11/1996 | Capdevila et al. | 415/210.1 |
| 5,927,944 | A * | 7/1999 | Belady | 415/220 |
| 6,045,327 | A * | 4/2000 | Amr | 415/211.2 |
| 6,481,963 | B1 | 11/2002 | Lin et al. | |
| 7,322,792 | B2 * | 1/2008 | Liu | 415/199.4 |
| 2002/0182071 | A1 * | 12/2002 | Belady | 415/220 |
| 2007/0154308 | A1 * | 7/2007 | Yang | 415/220 |

FOREIGN PATENT DOCUMENTS

| | | |
|---|---|---|
| CN | 2528992 Y | 1/2003 |
| CN | 200610033428.1 | 8/2007 |

* cited by examiner

*Primary Examiner* — Nitin Parekh
(74) *Attorney, Agent, or Firm* — Altis Law Group, Inc.

(57) ABSTRACT

An axial fan forms an air inlet on one side and an air outlet on an opposite side along an axis of the axial fan. The axial fan includes a base, a bearing, a stator and a rotor. A central tube extends upwardly from the base. The stator is around the central tube. The bearing is received in the central tube of the base. The rotor is rotatably supported by the bearing. The rotor includes a hub, a plurality of rotary blades extending outwardly from the hub, and an annular wall surrounding the rotary blades. The annular wall connects to outer ends of the rotary blades to rotate with the rotary blades to guide airflow from the air inlet to the air outlet during rotation of the rotary blades.

12 Claims, 4 Drawing Sheets

AXIAL FAN

BACKGROUND

1. Field of the Disclosure

The disclosure relates to an axial fan, and more particularly to an axial fan providing increased airflow and reduced operating noise.

2. Description of Related Art

With continuing developments in technology, electronic packages such as CPUs (central processing units) generating more heat that requires immediate dissipation. Axial fans are commonly used in combination with heat sinks for cooling CPUs.

Often, an axial fan includes a stator and a rotor. The rotor includes a hub and a plurality of fan blades extending outwardly therefrom. A permanent magnet is arranged in the hub and surrounds the stator. The stator includes a stator core with coils wound therearound. When electrical current is supplied to the coils, the fan blades, rotated by magnetic force of the coils, produce forced airflow. A fan housing surrounding the stator and the rotor guides the forced airflow from one side to an opposite side. However, during operation, while the fan blades rotate, the housing is stationary, and a gap is defined between the outer ends of the blades and the housing to avoid friction therebetween. Accordingly, size of the fan blades is limited, which correspondingly limits airflow. In addition, airflow from the rotary fan blades impacts the stationary fan housing, increasing noise of the axial fan.

For the foregoing reasons, there is a need in the art for an axial fan which overcomes the described limitations.

SUMMARY

According to an exemplary embodiment of the disclosure, an axial fan defines an air inlet on one side and an air outlet on an opposite side along an axis of the fan. The axial fan includes a base, a bearing, a stator and a rotor. A central tube extends upwardly from the base, around which the stator is mounted. The bearing is received in the central tube of the base and the rotor is rotatably supported by the bearing. The rotor includes a hub, a plurality of rotary blades extending outwardly from the hub, and an annular wall surrounding the rotary blades. The annular wall connects to outer ends of the rotary blades and rotates therewith, guiding airflow from the air inlet to the air outlet during operation of the fan.

Other advantages and novel features of the disclosure will be drawn from the following detailed description of the exemplary embodiments of the disclosure with attached drawings.

DETAILED DESCRIPTION OF THE EMBODIMENTS

Figure 1:
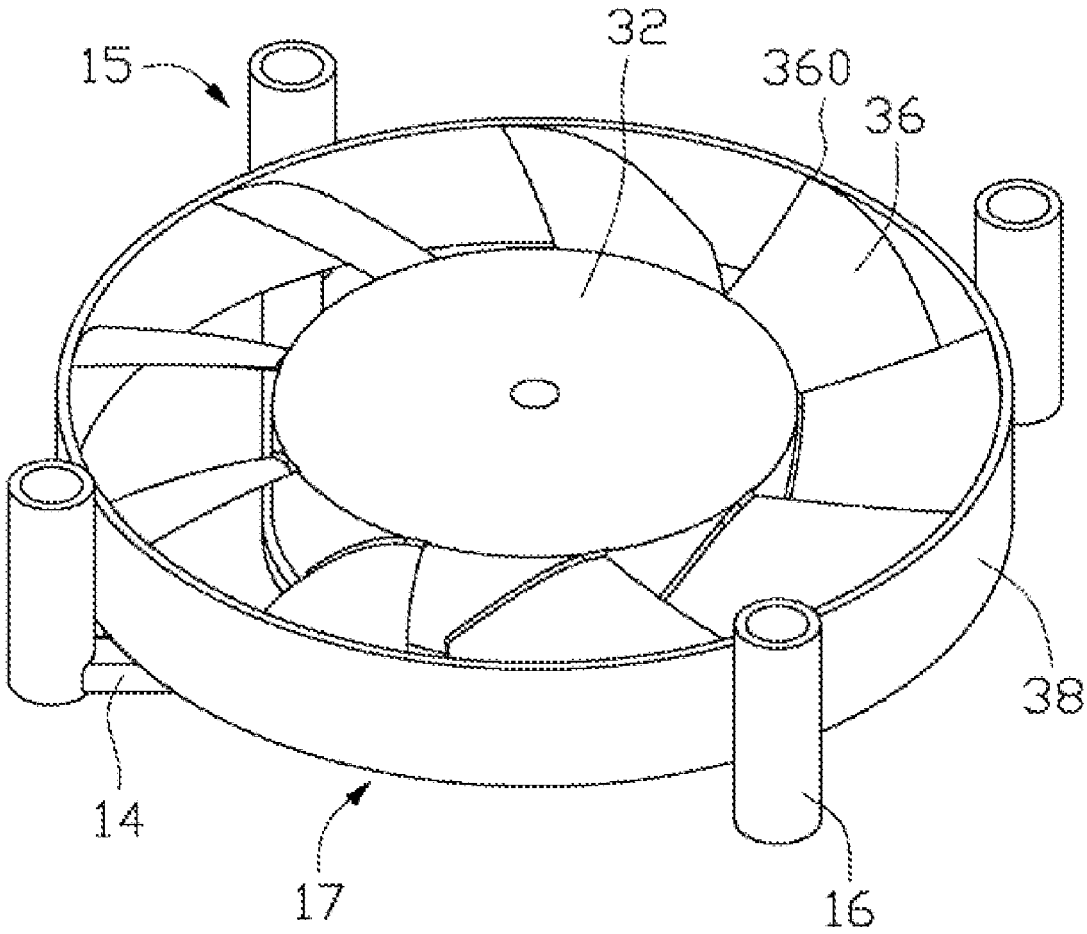
FIG. 1 is an assembled view of an axial fan according to an exemplary embodiment.

FIG. 1 shows an axial fan according to an exemplary embodiment. The axial fan is configured for producing forced airflow. A top side of the axial fan forms an air inlet 15 feeding airflow into the axial fan, and a bottom side of the axial fan forms an air outlet 17 exhausting airflow out the axial fan.

Figure 2:
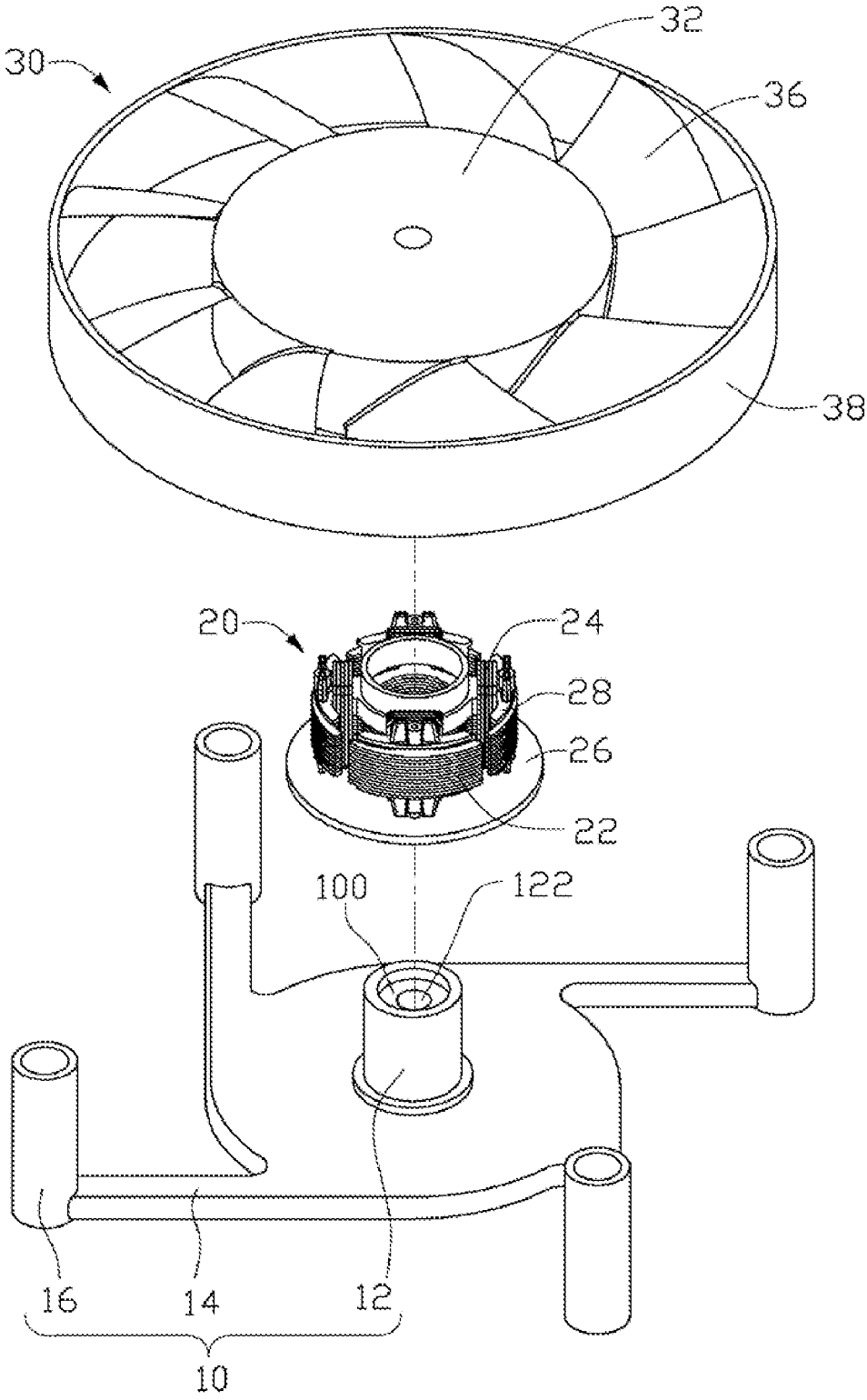
FIG. 2 is an exploded view of the axial fan of FIG. 1.

Referring to FIG. 2, the axial fan includes a base 10, a stator 20, and a rotor 30. The base 10 is substantially circular. Four ribs 14 extend outwardly along a tangential direction of the base 10. The ribs 14 are evenly arranged along a circumferential direction of the base 10. A fixing portion 16 is formed at a free end of each rib 14. In this embodiment, the fixing portion 16 is a cylinder extending upwardly from the free end of the rib 14, acting as a fixing member for fastening devices, such as a screw, to extend therethrough to fix the axial fan to other devices, such as a heat sink. A central tube 12 extends upwardly from a center of the base 10. A central hole 122 is defined in the central tube 12 receiving a bearing 100 therein.

The stator 20 is mounted around the central tube 12. The stator 20 includes a stator core 22 with coils 24 wound thereon to establish an alternating magnetic field, and a PCB 26 (printed circuit board) with electronic components mounted thereon. The electronic components are electrically connected with the coils 24 to control electrical current flowing through the coils 24. To prevent the coils 24 from making electrical contact with the stator core 22, a pair of insulating frames 28 cover the stator core 22.

Figure 3:
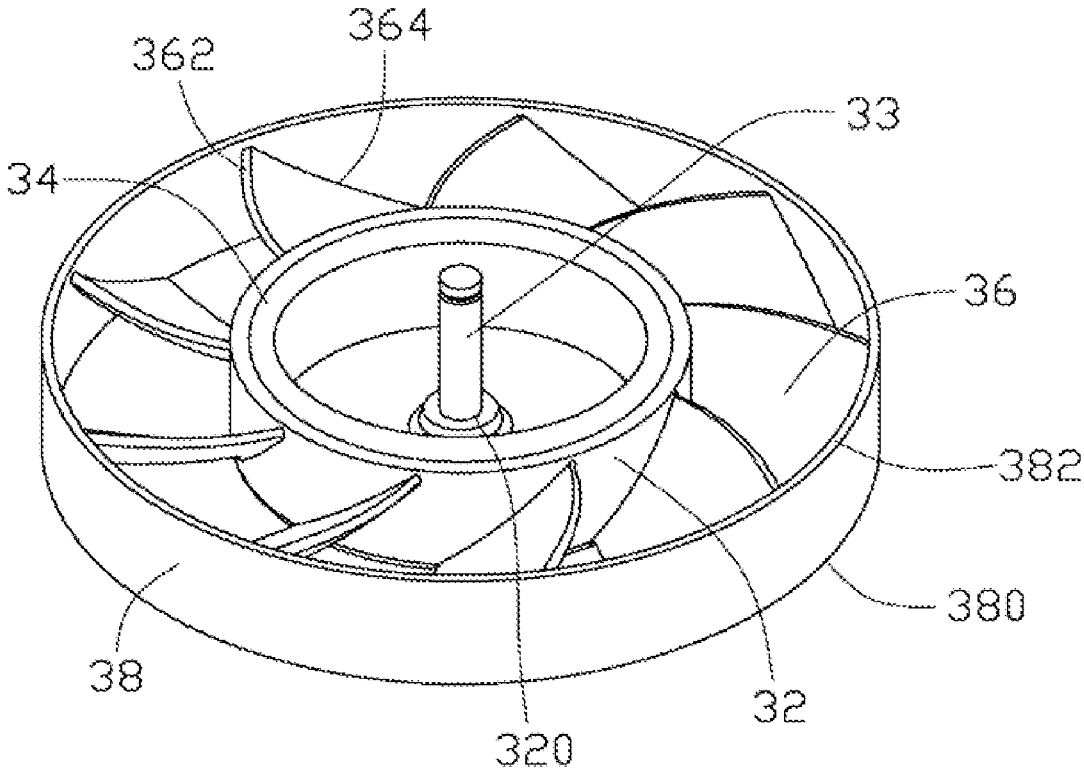
FIG. 3 shows a rotor of the axial fan of FIG. 1, viewed from a bottom aspect thereof.

Referring to FIG. 3, the rotor 30 includes a hub 32 forming a shaft seat 320 at a central portion thereof, a shaft 33 extending downwardly from the shaft seat 320 of the rotor 30, a magnet 34 adhered to an inner surface of the hub 32, a plurality of rotary blades 36 extending radially and outwardly from an outer periphery of the hub 32, and an annular wall 38 surrounding the rotary blades 36. The annular wall 38 connects to outer ends 364 of the rotary blades 36 and rotates therewith during rotation of the rotor 30. Height of the annular wall 38 along an axis of the rotor 30 is approximately the same as that of the rotary blades 36. A top side 380 of the annular wall 38 is approximately at the same level as an end 360 of each rotary blade 36 adjacent to the air inlet 15 of the axial fan, and a bottom side 382 of the annular wall 38 is approximately at the same level as a distal end 362 of the blade adjacent to the air outlet 17 of the axial fan.

After assembly, the stator 20 is fixed to the central tube 12. The shaft 33 of the rotor 30 extends into the bearing 100 and thus is rotatably supported thereby. The hub 32 of the rotor 30 surrounds the stator 20 with the magnet 34 confronting the coils 24 of the stator 20. The annular wall 38 of the rotor 30 is located among the four fixed portions 16. An outer surface of the annular wall 38 is spaced from the fixing portions 16, and the bottom side 382 of the annular wall 38 is higher than the base 10.

During operation, the rotor 30 is rotated by the interaction of the alternating magnetic field established by the stator 20 and the magnetic field of the magnet 34 of the rotor 30. The rotary blades 36 thus produce forced airflow. The annular wall 38 surrounding the rotary blades 36 guides the forced airflow from the air inlet 15 to the air outlet 17. Furthermore, the annular wall 38 is connected to the outer ends 364 of the rotary blades 36 and rotates with the rotary blades 36, increasing a sturdiness of the axial fan, such that operating noise of the axial fan is reduced. In addition, as the rotary blades 36 extend from the hub 32 to the annular wall 38, length of the rotary blade 36 along the extending direction increases, increasing airflow generated by the axial fan and correspondingly providing improved heat dissipation.

Figure 4:
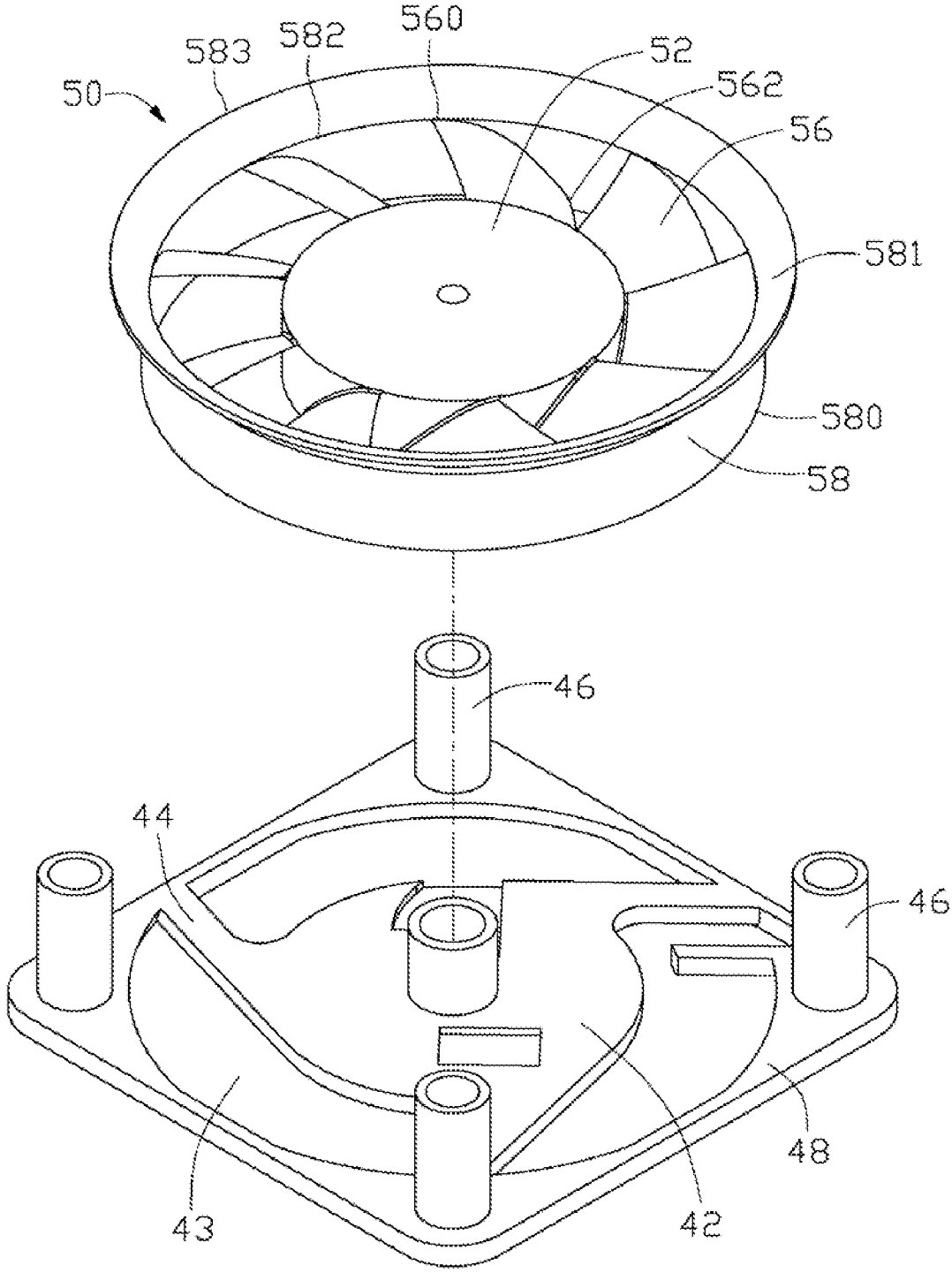
FIG. 4 shows an alternative embodiment of the axial fan.

FIG. 4 shows an alternative embodiment of the axial fan, differing from the previous embodiment in that a frame 48 is arranged around the base 42. The frame 48 is square, with an opening 43 defined in the frame 48 for airflow flowing therethrough. The base 42 is arranged at a center of the opening 43. Four fixing portions 46 extend from the four corners of the frame 48, respectively, for fixing the axial fan to a heat sink for example. Three ribs 44 extend from an outer periphery to an inner periphery of the frame 48, along a tangential direction and evenly arranged along the circumferential direction of the base 42. In addition, a guiding portion 581 extends outwardly and upwardly from a top side 582 of the annular wall 58. A top edge 583 of the guiding portion 581 is higher than the end 560 of the rotary blade 56, and a bottom side 580 of the annular wall 58 is substantially at the same level as the distal end 562 of the blade 56. The guiding portion 581 has a diameter gradually decreasing along the path of the airflow, concentrating the airflow onto the rotor 50, and increasing speed thereof accordingly.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. An axial fan comprising an air inlet on one side and an air outlet on an opposite side along an axis of the fan, comprising:

a base having a central tube extending outwardly therefrom;

a stator around the central tube of the base;

a bearing received in the central tube of the base; and a rotor rotatably supported by the bearing, the rotor comprising a hub, a plurality of rotary blades extending outwardly from the hub, and an annular wall surrounding the rotary blades, the annular wall connecting to outer ends of the rotary blades to rotate with the rotary blades to guide airflow from the air inlet to the air outlet during rotation of the rotary blades, a guiding portion extending outwardly from the annular wall, the guiding portion being convergent along the axis of the fan from the air inlet towards the air outlet, an outer face of the guiding portion inclining outwardly relative to an outer face of the annular wall.

2. The axial fan of claim 1, wherein a height of the annular wall along the axis is substantially the same as that of the rotary blades, a top side of the annular wall is approximately at the same level as ends of the rotary blades, and a bottom side of the annular wall is approximately at the same level as distal ends of the rotary blades.

3. The axial fan of claim 1, wherein the base is circular, with a plurality of ribs extending outwardly therefrom along a tangential axis thereof, each rib forming a cylinder adapted for assembling the axial fan to other device.

4. The axial fan of claim 1, wherein the base is circular, with a frame surrounding the base and a plurality of ribs interconnecting an inner periphery of the frame and an outer periphery of the base, and a plurality of cylinders extending upwardly from the frame adapted for connecting the axial fan to other device.

5. The axial fan of claim 4, wherein the frame is square, and each corner thereof comprises one cylinder extending upwardly therefrom.

6. An axial fan comprising an air inlet at a top side and an air outlet at a bottom side, comprising:

a circular base having a plurality of fixing portions formed therearound, for fixing the base to other device, and a central tube extending upwardly from a central portion of the base;

a stator mounted around the central tube;

a bearing received in the central tube; and a rotor comprising a hub, a shaft extending from a center of the hub into the bearing, a plurality of rotary blades extending outwardly from the hub, and an annular wall surrounding and connected to outer ends of the rotary blades, wherein the annular wall is inside the fixing portions and spaced from the fixing portions, a guiding portion extending outwardly and upwardly from the annular wall, the guiding portion being convergent along a direction from the air inlet towards the air outlet, an outer face of the guiding portion inclining outwardly relative to an outer face of the annular wall.

7. The axial fan of claim 6, wherein height of the annular wall along the axis is substantially the same as that of the rotary blades, a top side of the annular wall is approximately at the same level as ends of the rotary blades, and a bottom side of the annular wall is approximately at the same level as distal ends of the rotary blades.

8. The axial fan of claim 6, wherein the base further comprises a plurality of ribs extending outwardly therefrom, and a hollow frame connected to outer ends of the ribs, and the fixing portions are formed on the frame.

9. The axial fan of claim 8, wherein the frame is square, and the fixing portions comprise a plurality of cylinders extending upwardly from corners of the frame.

10. The axial fan of claim 6, wherein the base further comprises a plurality of ribs extending outwardly therefrom, and the fixing portions comprise a plurality of cylinders extending upwardly from outer ends of the ribs.

11. A rotor for an axial fan, the rotor comprising:

a hub;

a plurality of rotary blades extending outwardly from an outer face of the hub;

an annular wall surrounding and connected to outer ends of the rotary blades; and a guiding portion extending outwards from an end of the annular wall, the guiding portion expanding along a direction away from the annular wall, the guiding portion being convergent along the axis of the fan from the air inlet towards the air outlet, and, an outer face of the guiding portion being inclined relative to an outer face of the annular wall.

12. The rotor of claim 11, wherein the hub, the blades, the annular wall and the guiding portion are integrally formed as one piece.

* * * * *